US006278278B1

(12) United States Patent
Fisch

(10) Patent No.: US 6,278,278 B1
(45) Date of Patent: Aug. 21, 2001

(54) MEASURING AND DIAGNOSTIC DEVICE FOR AN IGNITION SYSTEM OF AN INTERNAL COMBUSTION ENGINE

(75) Inventor: Alfons Fisch, Falkenstein (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/503,661

(22) Filed: Feb. 14, 2000

Related U.S. Application Data

(63) Continuation of application No. PCT/DE98/02342, filed on Aug. 12, 1998.

(51) Int. Cl.[7] ..... F02P 17/00
(52) U.S. Cl. ..... 324/380; 324/388
(58) Field of Search ..... 324/380, 388, 324/379, 378; 123/644, 630

(56) References Cited

U.S. PATENT DOCUMENTS 4,331,922 5/1982 Walker .
4,454,560 6/1984 Nakao et al. .
4,594,993 * 6/1986 Engel et al. ..... 123/568.27
5,406,921 * 4/1995 Noble et al. ..... 123/479
5,526,788 * 6/1996 Noble et al. ..... 123/406.37

FOREIGN PATENT DOCUMENTS

2759155C2 4/1986 (DE) .
4039356C1 7/1992 (DE) .
0386431A2 9/1990 (EP) .
0740072A1 10/1996 (EP) .

* cited by examiner

*Primary Examiner*—Safet Metjahic
*Assistant Examiner*—Vincent Q. Nguyen
(74) *Attorney, Agent, or Firm*—Herbert L. Lerner; Laurence A. Greenberg; Werner H. Stemer

(57) ABSTRACT

The primary-side voltage profile of an ignition voltage is converted into an analog current through the use of a first regulating circuit, whose output voltage is compared with a first comparison voltage in a first comparator. The output voltage is compared with a second comparison voltage in a second comparator. A diagnostic signal for the ignition switch can be tapped at the output of the first comparator, and a measurement signal for the burning duration can be tapped at the output of the second comparator.

9 Claims, 2 Drawing Sheets

MEASURING AND DIAGNOSTIC DEVICE FOR AN IGNITION SYSTEM OF AN INTERNAL COMBUSTION ENGINE

CROSS-REFERENCE TO RELATED APPLICATION

This application is a continuation of copending International Application No. PCT/DE98/02342, filed Aug. 12, 1998, which designated the United States.

BACKGROUND OF THE INVENTION

Field of the Invention

The invention relates to a measuring and diagnostic device for an ignition system of an internal combustion engine.

German Patent DE 40 39 356 C1 discloses a circuit configuration for determining the discharge voltage of an ignition system of an internal combustion engine. The circuit configuration evaluates the spark plug discharge voltage, which is transformed to the primary side of an ignition coil, through the use of a voltage converter connected as an emitter follower.

German Patent DE 27 59 155 C2 discloses a circuit configuration for detecting the spark burning duration in ignition devices for internal combustion engines. Using an integrator device and a downstream-connected trigger device, the primary-side ignition voltage profile of a transistor-controlled ignition coil is converted with a predetermined response voltage into a square-wave pulse whose duration corresponds to the spark burning duration.

U.S. Pat. No. 4,331,922 discloses a diagnostic device for an ignition system of an internal combustion engine for monitoring the battery voltage, the ignition switch and the spark head voltage. The diagnostic device has a plurality of comparators for comparing the primary voltage with different reference voltages, the comparator outputs being connected via peak value storage circuits to a logic unit which controls devices for indicating faulty conditions.

Since the primary-side ignition voltage across the ignition switch has relatively high voltage levels being above the input voltage range of standard operational amplifiers, particularly complicated clamping circuits are necessary. In addition, the task is not accomplished by the comparators alone, rather a plurality of peak value store circuits are necessary, and also an evaluation logic unit.

In the course of the development of ignition systems in internal combustion engines, it has been shown that it is necessary to protect the ignition switch (power output stage transistor) against destruction if, by way of example, the primary winding of the ignition coil has a short circuit to the positive terminal of the battery voltage source. In addition, for diagnostic purposes, it is helpful to detect the spark burning duration and take suitable measures if the duration lies outside a predetermined desired value range.

A characteristic evaluation signal from which the two phenomena mentioned above can be measured and evaluated is the primary-side profile of the ignition voltage.

With the power output stage switched on, the primary-side ignition voltage has a low level of the order of magnitude of approximately 2V and, after the current flow through the primary winding is switched off at the ignition instant, momentarily rises to approximately 300 to 400V (spark head) until a flashover occurs at the spark plugs on the secondary side. The primary-side ignition voltage then levels out at a value above the battery voltage Vbat which depends on the battery voltage, the burning voltage of the spark gap and on the transformation ratio of the ignition coil. As soon as the energy stored in the ignition coil has then dissipated, the primary-side ignition voltage swings back to a value corresponding to the battery voltage Vbat.

The primary-side ignition voltage Upr thus has relatively high voltage levels which lie above the input voltage range of integrated circuits and necessitate special clamping circuits.

SUMMARY OF THE INVENTION

It is accordingly an object of the invention to provide a measuring and diagnostic device for an ignition system of an internal combustion engine which overcomes the above-mentioned disadvantages of the heretofore-known devices of this general type, which is suitable in particular for integrated circuits, which makes it possible for the relatively large level differences of the primary-side ignition voltage in the range of interest to be reliably detected and evaluated through the use of simple circuitry measures in a wide temperature range with a single reference voltage, and at the same time, in addition to generating a signal for measuring the spark burning duration, also monitors the ignition switch and, if a fault is identified, generates signals which, when they occur, enable the ignition switch or the internal combustion engine to be protected against destruction by being switched off.

With the foregoing and other objects in view there is provided, in accordance with the invention, for an internal combustion engine having an ignition system with an ignition coil and with an ignition switch, the ignition coil having a primary coil supplied with a battery voltage, the ignition switch connected to the primary coil via a junction point for periodically interrupting a current through the primary coil, a measuring and diagnostic device, including:

a protective resistor;

a first regulating circuit having an input to be connected, via the protective resistor, to the junction point between the primary coil and the ignition switch and having an output;

the first regulating circuit including a first linear amplifier having a non-inverting input connected to the input of the first regulating device, having an inverting input supplied with a reference voltage, and having an output connected to the output of the first regulating device;

the first regulating circuit including a first transistor having a base connected to the output of the first linear amplifier, having a collector connected to the input of the first regulating circuit, and having an emitter connected to ground;

a first comparator having a non-inverting input connected to the output of the first regulating circuit, an inverting input supplied with a first comparison voltage and having an output for outputting a diagnostic signal;

a first resistor and a second resistor;

a second regulating circuit, configured identical to the first regulating circuit, having an output and having an input connected, via the first resistor, to the battery voltage and connected to an auxiliary voltage via the second resistor;

the second regulating circuit including a second linear amplifier having a non-inverting input connected to the input of the second regulating circuit, having an inverting input supplied with the reference voltage, and having an output connected to the output of the second regulating circuit;

the second regulating circuit including a second transistor having a base connected to the output of the second linear amplifier, having a collector connected to the input of the second regulating circuit, and having an emitter connected to ground; and a second comparator having a non-inverting input connected to the output of the second regulating circuit, having an inverting input connected to the output of the first regulating circuit and having an output for outputting a measurement signal.

In accordance with another feature of the invention, the protective resistor and the first resistor have identical resistances.

In accordance with yet another feature of the invention, the reference voltage is greater than the maximum saturation voltage of the ignition switch.

In accordance with a further feature of the invention, the first linear amplifier turns the first transistor off, if the primary voltage is less than the reference voltage, and turns the first transistor on if the primary voltage is greater than the reference voltage.

In accordance with yet a further feature of the invention, the first linear amplifier turns on the first transistor when Upr>Uref to such an extent that a first current I1=(Upr−Uref)/R1 is established through the protective resistor, which effects a voltage drop Upr−Uref across the protective resistor.

In accordance with another feature of the invention, the first comparison voltage has a value of 0V<V1<0.7V.

In accordance with yet another feature of the invention, the first and the second resistor are dimensioned in such a way that the second current corresponding to the sum of the currents flowing through them is greater than the first current through the protective resistor if the primary voltage corresponds to the battery voltage, and is less than the current through the protective resistor if the primary voltage corresponds to the burning voltage transformed to the primary side.

In accordance with a further feature of the invention, the control signal of the ignition switch, the diagnostic signal and the measurement signal are combined with one another in such a way that fault signals are output if Ust=H and at the same time IGBT-Diag=H, Ust=L and at the same time IGBT-Diag=L, Ust=L and at the same time IGN-Diag=H, Duration of IGN-Diag<D1, Duration of IGN-Diag>D2.

In accordance with yet a further feature of the invention, the second comparator is designed as a current comparator to whose inputs the first and the second current are fed via current mirror circuits.

The circuit of the measuring and diagnostic device according to the invention advantageously includes relatively few components and they are well suited to integration.

Other features which are considered as characteristic for the invention are set forth in the appended claims.

Although the invention is illustrated and described herein as embodied in a measuring and diagnostic device for an ignition system of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DESCRIPTION OF THE PREFERRED EMBODIMENTS

Figure 1:
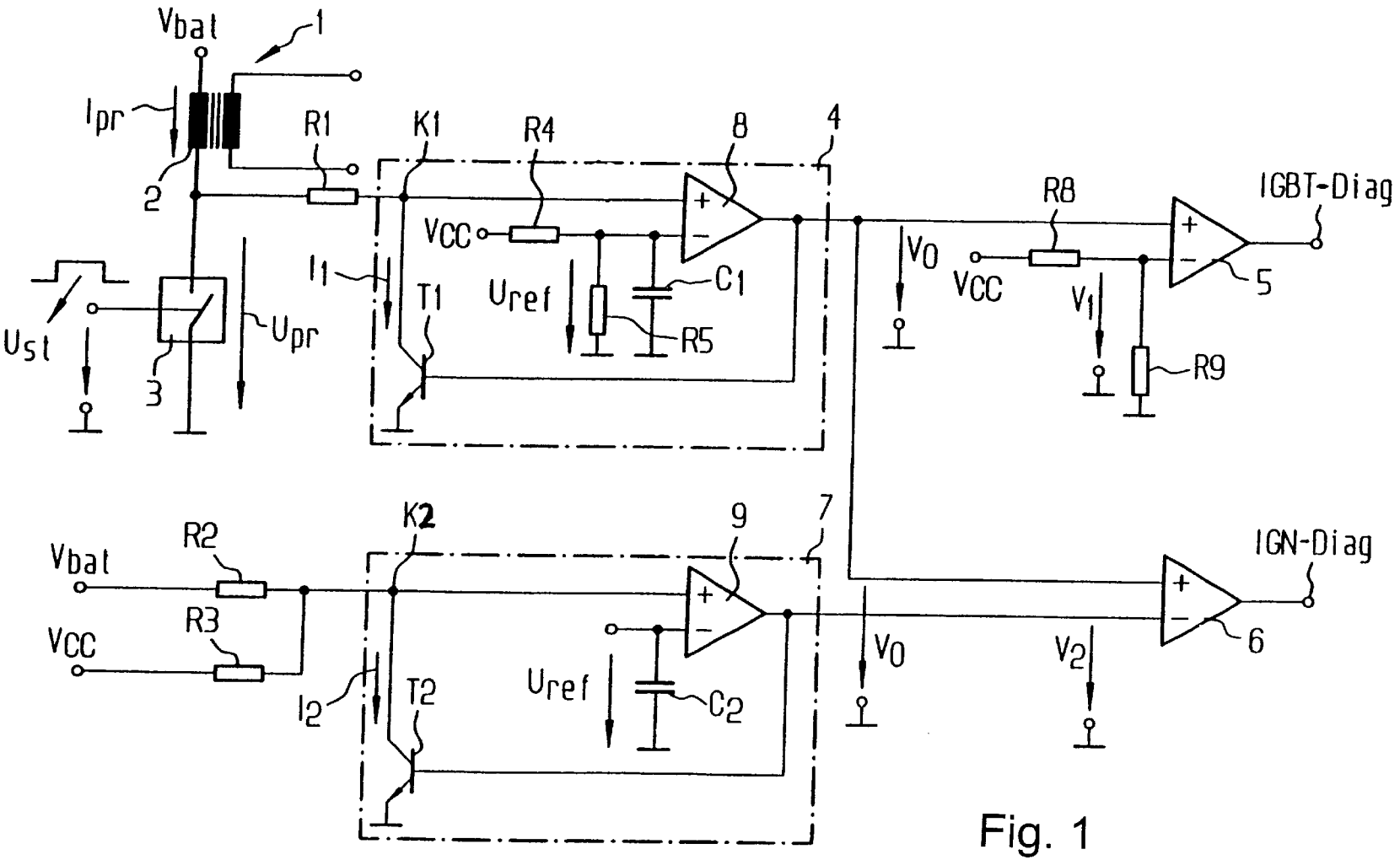
FIG. 1 is a schematic circuit diagram of a measuring and diagnostic device according to the invention for an ignition system of an internal combustion engine.

Referring now to the figures of the drawings in detail and first, particularly, to FIG. 1 thereof, there is shown a circuit diagram of a measuring and diagnostic device. A battery voltage Vbat (for example +12V) of an on-board voltage source is applied to a series circuit formed by an ignition coil 1 and an ignition switch 3. The ignition switch 3, using control signals Ust fed to it, switches the primary current Ipr through the primary winding 2 of the ignition coil 1 on and off periodically, thereby producing the above-described profile of the ignition voltage Upr across the ignition switch 3. The profile of the ignition voltage Upr is evaluated for measuring and diagnostic purposes.

A series circuit, formed by a protective resistor R1 and a first transistor T1, is connected between the junction point of the primary coil 2 and the ignition switch 3 and ground (negative terminal of the on-board voltage source), the emitter of the transistor T1 being connected to ground and its collector being connected to the protective resistor R1.

The transistor T1 is part of a first regulating circuit 4, which includes an operational amplifier connected as a first linear amplifier 8. The non-inverting input "+" of the amplifier is connected to the junction point K1 between the collector of the transistor T1 and the protective resistor R1. The junction point K1 serves as the input of this regulating circuit. A reference voltage Uref (for example +3V), which is obtained from an auxiliary voltage Vcc (for example +5V) through the use of a voltage divider R4, R5 in this exemplary embodiment, is applied to the inverting input "−" of the amplifier 8. A capacitor C1 is connected in parallel with the resistor R5 in order to mask out possible interference voltages. The output of the first linear amplifier 8 is connected to the base of the first transistor T1.

The output of the first regulating circuit 4 is also connected to the non-inverting input "+" of a first comparator 5, to whose inverting input "−" is applied a first comparison voltage V1 (for example +0.3V), which, by way of example, is obtained from the auxiliary voltage Vcc (+5V) through the use of a voltage divider R8, R9. A diagnostic signal IGBT-Diag can be tapped off at the output of the first comparator 5.

Furthermore, a second regulating circuit 7 with a structure identical to that of the first regulating circuit 4 is provided, which has a second transistor T2 and a second linear amplifier 9. In this case, too, the reference voltage Uref (+3V) is applied to the inverting input "−", and the collector of the second transistor T2 and the non-inverting input "+" of the second linear amplifier 9 are connected via an input K2 which, on the one hand, is connected via a resistor R2 to the battery voltage Vbat and, on the other hand, is connected via a resistor R3 to the auxiliary voltage Vcc. The resistors R1, R2 and R3 may be external, non-integrated resistors in order to better adapt the circuit to different requirements.

The output of the second regulating circuit 7 is connected to the non-inverting input "+" of a second comparator 6, whose inverting input "−" is connected to the output of the first regulating circuit 4. A measurement signal IGN-Diag can be picked off at the output of the second comparator 6.

The circuit described above operates as follows. The primary voltage Upr is fed to the regulating circuit 4 via the protective resistor R1. The regulating circuit operates in such a way that it always attempts to set at the input K1 a voltage which is equal to the reference voltage Uref, which is preferably chosen to be somewhat greater than the maximum saturation voltage of the ignition switch.

If the primary voltage Upr is less than the reference voltage Uref, then the transistor T1 is turned off by the output signal Vo of the linear amplifier 8 (Vo=0V) and no voltage drop ensues across the protective resistor R1. This is the case (Upr≈2.3V<Uref=3V) given the presence of a control signal Ust in the on state (conducting state) of the intact ignition switch 3, which is configured as an IGBT (Insulated Gate Bipolar Transistor) in this exemplary embodiment.

If, on the other hand, the primary voltage Upr is greater than the reference voltage Uref, which is the case in the off state (non-conducting state) of the intact ignition switch 3 or in the event of a short circuit to the battery voltage, then the difference voltage Upr−Uref drops across the protective resistor R1, in that the linear amplifier, by increasing its output signal Vo>0.7V, turns on the transistor T1 to such an extent that the voltage Uref is present at the input K1. In other words, a voltage Upr−Uref drops across the protective resistor R1. A first current I1=(Upr−Uref)/R1 then flows through the protective resistor Ri and through the transistor T1.

The output signal Vo of the first linear amplifier 4 is compared with the first comparison voltage V1=0.3V in the first comparator 5. The output signal of the first comparator 5, namely the diagnostic signal IGBT-Diag, is:

IGBT-Diag=L (Low), if Upr<Uref;

IGBT-Diag=H (High), if Upr>Uref.

The diagnostic signal IGBT-Diag can be combined with the control signal Ust of the ignition switch 3 through the use of a discrete logic circuit. As an alternative to this it is possible to process the control signal Ust with the diagnostic signal IGBT-Diag in a microcontroller. This allows to generate a digital fault signal F through the use of which the ignition switch 3 can be switched off and thus protected against destruction if, by way of example, the primary winding 2 exhibits a short circuit to the battery voltage Vbat:

F=H, if Ust=H and at the same time IGBT-Diag=H;

F=H, if Ust=L and at the same time IGBT-Diag=L.

The ignition system is switched off immediately in this case.

The second regulating circuit 7 is fed with a current IR2 from the on-board voltage source via the resistor R2, which has the same resistance as the protective resistor R1. The current IR2, if the reference voltage Uref is intended to be present at the input K2, has a value IR2=(Vbat−Uref)/R2. At the same time, a current IR3 is fed from the auxiliary voltage source Vcc to the second regulating circuit 7 via the resistor R3. The current IR3 has, under the same conditions, a value IR3=(Vcc−Uref)/R3.

Accordingly, a second current I2=IR2+IR3 flows through the second transistor T2. The second current I2, in the case where the primary voltage Upr is equal to the battery voltage Vbat, is greater than the first current I1 flowing through the first transistor T1:

(Vbat−Uref)/R2≡(Vbat−Uref)/R1, since R1=R2.

In order that this larger second current can flow through the transistor T2, the latter must be turned on by the second linear amplifier 9 to a greater extent than T1, that is to say the output signal V2 of the second regulating circuit 7 is greater than the output signal Vo of the first regulating circuit 4 in the case of Upr=Vbat.

The output signals Vo and V2 of the two regulating circuits 4 and 7 are compared with one another in the second comparator 6, where, in the case of Upr=Vbat, the output signal of the second comparator 6, namely the measurement signal IGN-Diag, is a High signal: IGN-Diag=H.

Only when I1>I2 occurs, which is the case when, for instance, Upr=Vbat+3V (which is reliably exceeded in the case of an intact ignition system after the ignition switch 3 is switched off during the burning duration of the ignition spark in a spark plug) does Vo>V2 and thus the measurement signal IGN-Diag=L occur. The duration of this Low state of the measurement signal IGN-Diag corresponds to the burning duration of the respective spark plug. This duration can be measured digitally and compared with threshold values.

The resistors R2 and R3 are accordingly dimensioned in such a way that

I1<I2 or Vo<V2, if Upr=Vbat, and

I1>I2 or Vo>V2, if Upr=burning voltage.

The following states can be ascertained using the measurement signal IGN-Diag:

a) Burning duration by counting the duration of the measurement signal IGN-Diag=L;

b) Interruption or short circuit to the battery voltage of the primary circuit: in this case, the measurement signal IGN-Diag=H remains after the end of the control signal Ust;

c) Interruption in an ignition cable or ignition cable connector that has fallen off: in this case, a very short burning duration (IGN-Diag=L) results after the end of the control signal Ust; it is shorter than a first predetermined duration D1;

d) Secondary short circuit in an ignition cable or a spark plug or contaminated spark plug: in this case, the burning duration (IGN-Diag=L) is longer than a second predetermined duration D2 after the end of the control signal Ust.

In cases b, c and d, it is possible to take suitable measures (switching off the ignition switch) for protecting the ignition system.

Figure 2:
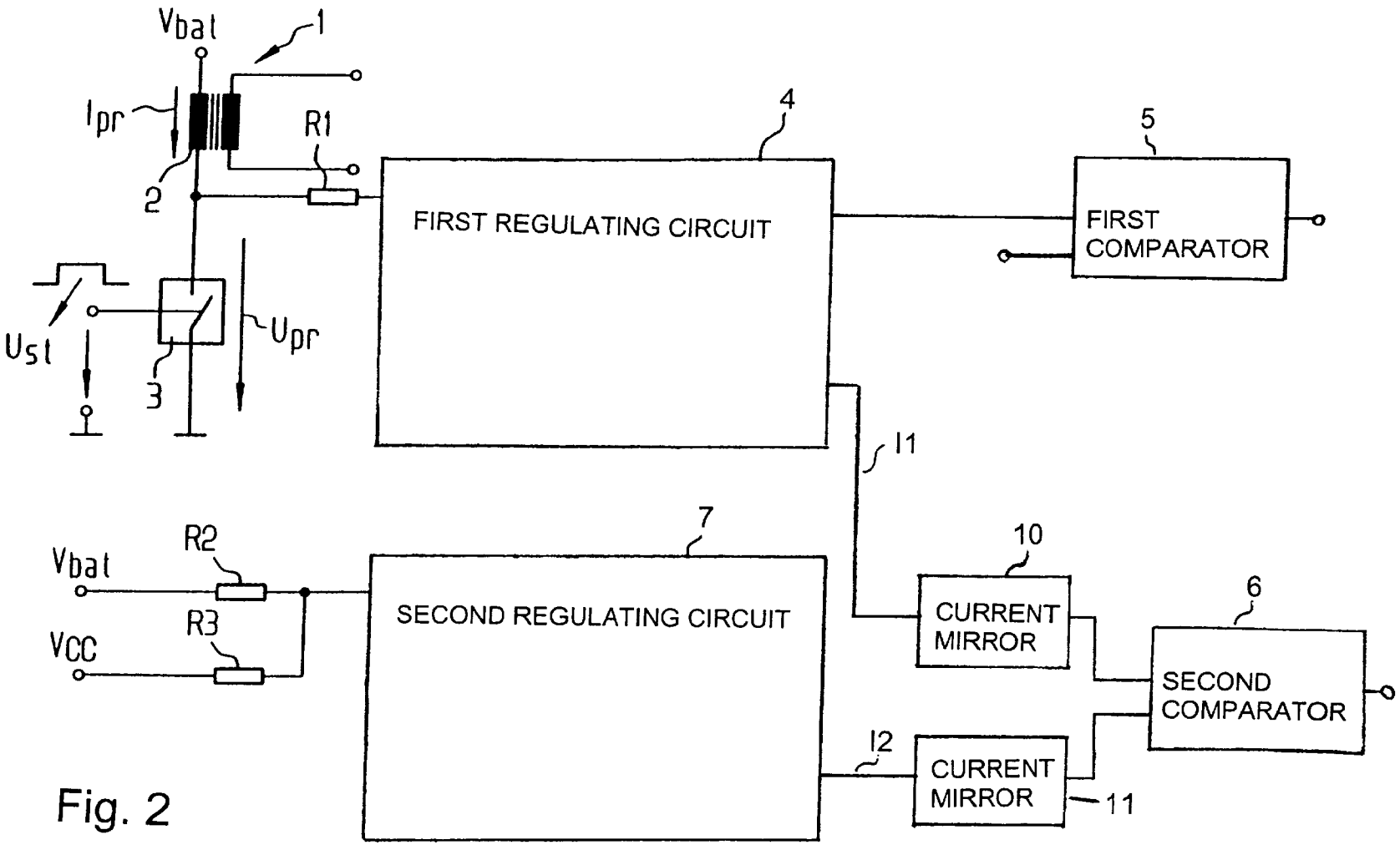
FIG. 2 is a circuit block diagram of a measuring and diagnostic device according to the invention suited for monolithic integration.

In the event of a monolithic integration of the measuring and diagnostic device, the currents I1 and I2 may serve as (analog) reference currents, in which case the comparator 6 may be configured as current comparator to which the currents I1 and I2 are fed through the use of current mirror circuits. FIG. 2 illustrates a measuring and diagnostic device which uses the currents Il and I2 as reference currents. The first and second regulating devices 4, 7 supply the currents I1 and I2, via current mirrors 10, 11 to the second comparator 6, which in this case is a current comparator. It is also possible to correspondingly provide the first comparator 5 as a current comparator.

I claim:

1. In an internal combustion engine having an ignition system with an ignition coil and with an ignition switch, the ignition coil having a primary coil supplied with a battery voltage, the ignition switch connected to the primary coil via a junction point for periodically interrupting a current through the primary coil, a measuring and diagnostic device, comprising:

a protective resistor;

a first regulating circuit having an input to be connected, via said protective resistor, to the junction point between the primary coil and the ignition switch and having an output;

said first regulating circuit including a first linear amplifier having a non-inverting input connected to said input of said first regulating circuit, having an inverting input supplied with a reference voltage, and having an output connected to said output of said first regulating circuit;

said first regulating circuit including a first transistor having a base connected to said output of said first linear amplifier, having a collector connected to said input of said first regulating circuit, and having an emitter connected to ground;

a first comparator having a non-inverting input connected to said output of said first regulating circuit, an inverting input supplied with a first comparison voltage and having an output for outputting a diagnostic signal;

a first resistor and a second resistor;

a second regulating circuit, configured identical to said first regulating circuit, having an output and having an input connected, via said first resistor, to the battery voltage and connected to an auxiliary voltage via said second resistor;

said second regulating circuit including a second linear amplifier having a non-inverting input connected to said input of said second regulating circuit, having an inverting input supplied with said reference voltage, and having an output connected to said output of said second regulating circuit;

said second regulating circuit including a second transistor having a base connected to said output of said second linear amplifier, having a collector connected to said input of said second regulating circuit, and having an emitter connected to ground; and a second comparator having an inverting input connected to said output of said second regulating circuit, having a non-inverting input connected to said output of said first regulating circuit and having an output for outputting a measurement signal.

2. The measuring and diagnostic device according to claim 1, wherein said protective resistor and said first resistor have substantially identical resistances.

3. The measuring and diagnostic device according to claim 1, wherein said inverting inputs of said first and second linear amplifiers are supplied with said reference voltage being greater than a maximum saturation voltage of the ignition switch.

4. The measuring and diagnostic device according to claim 1, wherein said first linear amplifier turns said first transistor off, when a primary voltage across the ignition switch is less than said reference voltage, and said first linear amplifier turns said first transistor on when the primary voltage is greater than said reference voltage.

5. The measuring and diagnostic device according to claim 1, wherein said first linear amplifier turns on said first transistor to a given extent, when Upr>Uref with Upr being a primary voltage across the ignition switch and Uref being said reference voltage, said first transistor turned on to said given extent establishing a first current through said protective resistor having a resistance value, such that I1=(Upr−Uref)/R1 with I1 being said first current and R1 being said resistance value of said protective resistor, said first current effecting a voltage drop Upr−Uref across said protective resistor.

6. The measuring and diagnostic device according to claim 1, wherein said inverting input of said first comparator is supplied with said first comparison voltage having a value of between 0V and 0.7V.

7. The measuring and diagnostic device according to claim 1, wherein said protective resistor has a first current flowing therethrough, said first and second resistors have respective current flows, a sum of said respective current flows through said first and second resistors forming a second current, said second current dimensioned to be greater than said first current through said protective resistor when a primary voltage across the ignition switch corresponds to the battery voltage, and said second current dimensioned to be less than said first current through said protective resistor if the primary voltage corresponds to a burning voltage transformed to a primary side of the coil.

8. The measuring and diagnostic device according to claim 1, wherein said diagnostic signal, said measurement signal and a control signal controlling the ignition switch are logically combined with one another such that a fault signal is output if one of the following conditions is met $$Ust = H, \text{ and at the same time } IGBT\text{-}Diag = H,$$

$$Ust = L, \text{ and at the same time } IGBT\text{-}Diag = L,$$

$$Ust = L, \text{ and at the same time } IGN\text{-}Diag = H,$$

$$\text{Duration of } IGN\text{-}Diag < D1,$$

$$\text{Duration of } IGN\text{-}Diag > D2,$$

wherein Ust is the control signal for the ignition switch, H is a logical High, L is a logical Low, IGBT-Diag is said diagnostic signal, IGN-Diag is said measurement signal, D1 is a first given duration and D2 is a second given duration.

9. In an internal combustion engine having an ignition system with an ignition coil and with an ignition switch, the ignition coil having a primary coil supplied with a battery voltage, the ignition switch connected to the primary coil via a junction point for periodically interrupting a current through the primary coil, a measuring and diagnostic device, comprising:

a protective resistor;

a first regulating circuit having an input to be connected, via said protective resistor, to the junction point between the primary coil and the ignition switch and having an output;

said first regulating circuit including a first linear amplifier having a non-inverting input connected to said input of said first regulating circuit, having an inverting input supplied with a reference voltage, and having an output connected to said output of said first regulating circuit;

said first regulating circuit including a first transistor having a base connected to said output of said first linear amplifier, having a collector connected to said input of said first regulating circuit, and having an emitter connected to ground;

a first comparator having a non-inverting input connected to said output of said first regulating circuit, an inverting input supplied with a first comparison voltage and having an output for outputting a diagnostic signal;

a first resistor and a second resistor;

a second regulating circuit having an input connected, via said first resistor, to the battery voltage and connected to an auxiliary voltage via said second resistor;

said second regulating circuit including a second linear amplifier having a non-inverting input connected to said input of said second regulating circuit, having an inverting input supplied with said reference voltage, and having an output;

said second regulating circuit including a second transistor having a base connected to said output of said second linear amplifier, having a collector connected to said input of said second regulating circuit, and having an emitter connected to ground; and a second comparator being configured as a current comparator and having an output for outputting a measurement signal;

current mirror circuits respectively connected between said first and second regulating devices and said second comparator; and said protective resistor having a first current flowing therethrough, said first and second resistors having respective current flows, a sum of said respective current flows of said first and second resistors forming a second current, said second comparator having inputs respectively supplied with said first and second currents via said current mirror circuits.

* * * * *